US008745957B2

(12) United States Patent
Hussain et al.

(10) Patent No.: US 8,745,957 B2
(45) Date of Patent: Jun. 10, 2014

(54) INDUCED MACRO-CELL CORROSION PREVENTION METHOD

(75) Inventors: Raja Rizwan Hussain, Riyadh (SA); Muhammad Wasim, Riyadh (SA)

(73) Assignee: King Saud University, Riyadh (SA)

( * ) Notice: Subject to any disclaimer, the term of this patent is extended or adjusted under 35 U.S.C. 154(b) by 121 days.

(21) Appl. No.: 13/444,744

(22) Filed: Apr. 11, 2012

(65) Prior Publication Data

US 2013/0269283 A1 Oct. 17, 2013

(51) Int. Cl.
*E04G 23/02* (2006.01)
*E04G 23/00* (2006.01)

(52) U.S. Cl.
CPC ..... *E04G 23/008* (2013.01); *E04G 23/0237* (2013.01)
USPC ..... 52/741.3; 52/741.41; 52/514; 52/514.5

(58) Field of Classification Search
USPC ..... 52/414, 514, 514.5, 583.1, 600, 601
See application file for complete search history.

(56) References Cited

U.S. PATENT DOCUMENTS

| | | | | |
|---|---|---|---|---|
| 2,128,480 | A * | 8/1938 | Wertz | 52/514 |
| 2,703,289 | A * | 3/1955 | Willson | 52/612 |
| 3,397,626 | A * | 8/1968 | Kornick et al. | 404/59 |
| 4,081,200 | A * | 3/1978 | Cheung | 404/90 |
| 4,632,796 | A * | 12/1986 | Moulet | 52/426 |
| 6,612,085 | B2 | 9/2003 | Edwards et al. | |
| 7,334,820 | B2 | 2/2008 | Fasel | |
| 2008/0155827 | A1 | 7/2008 | Fyfe | |

FOREIGN PATENT DOCUMENTS

| | | | |
|---|---|---|---|
| CA | 1235561 | A1 | 4/1988 |
| CM | 201071564 | Y | 6/2008 |
| CN | 101078283 | A | 11/2007 |
| DE | 3122940 | A1 | 12/1982 |
| JP | 2000273973 | A1 | 10/2000 |
| WO | WO 2005047603 | A1 | 5/2005 |

OTHER PUBLICATIONS

Design and Construction Practices to Mitigate Corrosion of Reinforcement in Concrete Structures, American Concrete Institute Report # 222.3R-03.

* cited by examiner

*Primary Examiner* — Mark Wendell
*Assistant Examiner* — Matthew J Smith
(74) *Attorney, Agent, or Firm* — Richard C Litman

(57) ABSTRACT

The induced macro-cell corrosion prevention method includes the step of replacing a corroded or chloride-contaminated section of a steel reinforcement or rebar in steel-reinforced concrete with a new rebar section free of chloride. A non-conductive insulating buffer is placed between the end sections of the new rebar and the corresponding end sections of adjacent chloride-contaminated rebar sections in order to form a non-conductive layer between the new steel and the old steel. This prevents or substantially reduces formation of a macro-cell that would cause a galvanic reaction to occur and increase corrosion potential.

3 Claims, 4 Drawing Sheets

INDUCED MACRO-CELL CORROSION PREVENTION METHOD

BACKGROUND OF THE INVENTION

1. Field of the Invention The present invention relates to construction repair methods, and particularly to an induced macro-cell corrosion prevention method in construction repairs that reduces or substantially eliminates corrosion at the rebar or steel reinforcement repair site in steel-reinforced concrete.

2. Description of the Related Art

Structural degradation of concrete structures due to corrosion of the reinforcing steel is one of the most extensive durability problems facing concrete structures. This gives rise to concerns about structural safety, integrity, and serviceability. The cost of rehabilitating such structures is very significant. Patch repair is the most commonly used method for rectifying localized damage in concrete due to corrosion. Patch repair entails removal of loose concrete that has cracked, spalled, or delaminated; the application of a surface treatment on the steel; and replacement of the defective concrete with patching materials, which normally re-establishes the original profile of the member. Several researchers have studied the patch repairs of corroded reinforced concrete. One study shows that the major cause of degradation of the repairs arises from the adverse interaction between the repaired area and adjacent unrepaired areas, which, in turn, stems from poor performance of the repaired area as a result of mechanical failures. The principles of electrochemical incompatibility have been widely discussed, and the existence of macro-cell corrosion has been experimentally demonstrated emphasizing that both micro-cell and macro-cell corrosion could coexist in active corrosion, and a newly induced macro-cell might not necessarily suppress existing micro-cell corrosion.

In light of the above, it would be a benefit in the art of concrete repair to provide a method of repairing concrete that minimizes or prevents corrosion in corroded concrete. Thus, an induced macro-cell corrosion prevention method solving the aforementioned problems is desired.

SUMMARY OF THE INVENTION

The induced macro-cell corrosion prevention method includes the step of replacing a corroded or chloride-contaminated section of a steel reinforcement or rebar in steel-reinforced concrete with a new rebar section free of chloride. A non-conductive insulating buffer is placed between the end sections of the new rebar and the corresponding end section of adjacent chloride-contaminated rebar sections so as to form a non-conductive layer between the new steel and the old steel. This prevents or substantially reduces formation of a macro-cell that would cause a galvanic reaction to occur and increase corrosion potential.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
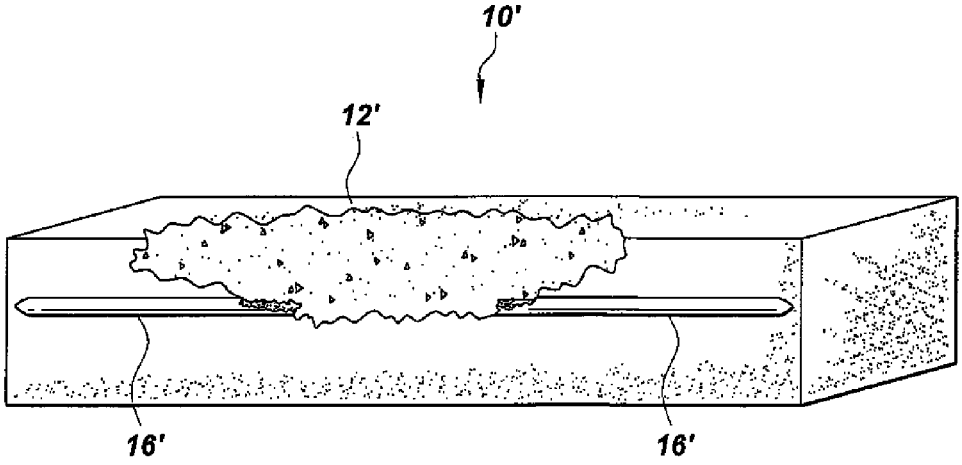
FIG. 1A is a perspective view of a simulated reinforced concrete specimen with a section of corroded concrete and steel reinforcement.
Figure 2:
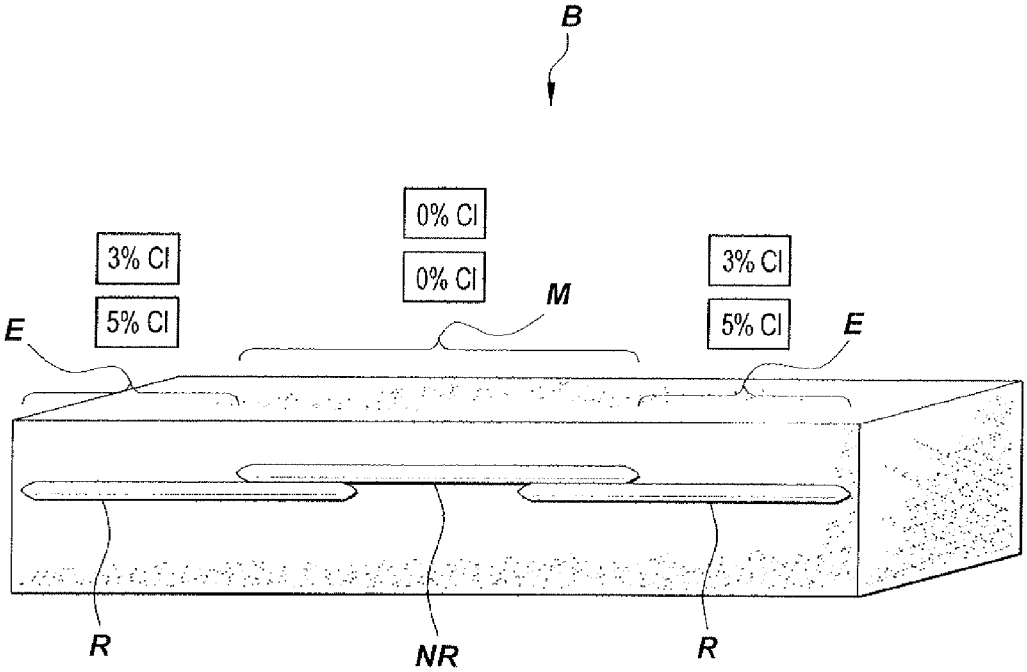
Fig. 2 PRIOR ART
FIG. 2 is a perspective view, largely diagrammatic, of a simulated reinforced concrete section repaired according to a method of the prior art.

The induced macro-cell corrosion prevention method prevents or substantially minimizes reoccurrence of corrosion in a repaired section of corroded concrete. As shown in FIG. 1A, reinforced concrete block 10' depicts a corroded section 12' and corroded reinforcing steel bar or rebar 16'. As shown in FIG. 2, the typical repair of a structurally compromised concrete section of steel-reinforced concrete according to the prior art is shown in the simulated, reinforced concrete block B. In this example, the opposing end sections E, E contain a certain percentage by weight of chlorine (Cl), chlorine or chloride ion (Cl—) being a typical electrochemical component in concrete that promotes galvanic reaction that causes the rebar R to corrode. In a typical repair, the middle or repaired section M is filled with fresh concrete free of Cl. Prior to this patching, the corroded section of the rebar R running through the middle section M has been cut and patched with a new steel rebar section NR, the ends thereof overlapping in contact with the cut ends of the old rebar R. The new rebar section NR is not contaminated with chloride. Unfortunately, that creates a macro-cell that allows an electrochemical cathodic reaction to occur between the old rebar R and the new rebar R, which can facilitate corrosion in the repaired section in a relatively short period of time.

Figure 1:
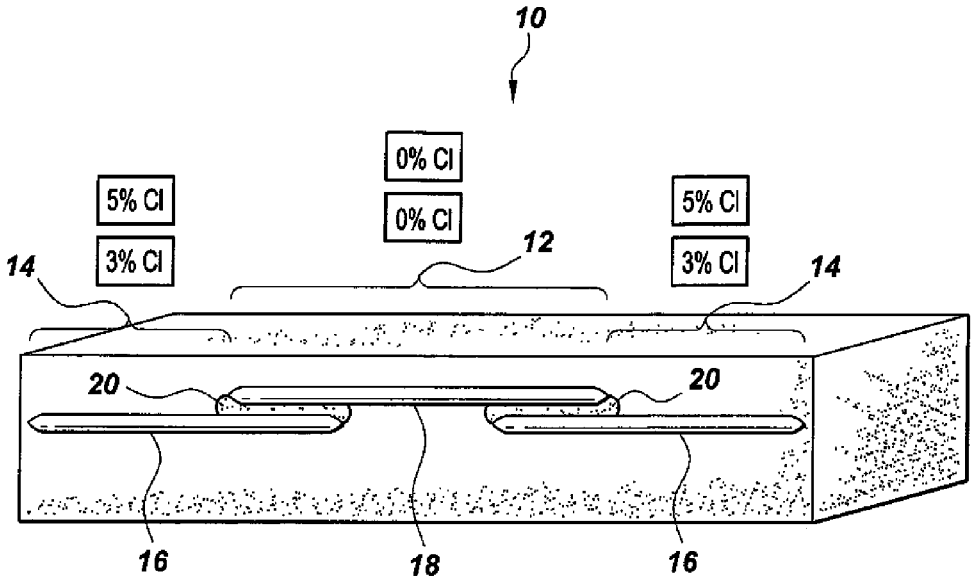
FIG. 1 is a perspective view, largely diagrammatic, of a simulated reinforced concrete specimen repaired using an induced macro-cell corrosion prevention method according to the present invention.

In contrast, FIG. 1 shows a simulated, reinforced concrete block 10 repaired according to the present method. The block 10 includes a middle or repaired section 12 and opposing end sections 14, the opposing end sections 14 containing a certain percentage by weight of Cl to simulate reinforced concrete contaminated by chlorine or chloride ion. A reinforcing steel bar or rebar 16 runs longitudinally through the concrete block 10. The middle section 12 has been repaired in substantially the same manner as above with new concrete free of Cl and a new steel rebar section 18 attached to the cut end sections of rebar 16. The new steel rebar section 18 is also free of chloride contamination. However, a buffer 20 has been placed between the new rebar section 18 and the old rebar 16 at the area of attachment. In the non-limiting exemplary embodiment, the buffer 20 is preferably made from non-conductive and insulating material. Some non-limiting examples of such a material include plastics and polymers. For optimum results, the buffer 20 is attached to the rebar section 18 and the rebar 16 in such a manner that there is no metal-to-metal contact therebetween.

By placing this buffer 20 between the new chloride-free rebar section 18 and the chloride-contaminated rebar 16, it has been found that there was a much lower corrosion potential in the middle section 12 compared to the typical prior art repair exemplified in FIG. 2. Moreover, the reinforced concrete block 10 exhibited no significant signs of recurring corrosion, compared to the reinforced concrete B. The following describes the year long experiment and testing that support the findings.

EXAMPLE

Deformed round carbon steel bars 13 mm in diameter were used as reinforcing material in the experiment specimens. Ordinary Portland cement (OPC) as per JIS R5210 specifications was used. Natural river sand passed through JIS A1102 sieve No. 4 (4.75-mm openings) was used as fine aggregate for all concrete mixes. The density and water absorption were 2.65 g/cm3 and 2.21%, respectively, for the fine aggregate. Crushed sandstone with a maximum size of 20 mm was used as coarse aggregate with a density of 2.70 g/cm3 and water absorption 0.59%. Table 1 illustrates the mix proportion of the specimens.

TABLE 1

| Mix proportions | | | | | |
|---|---|---|---|---|---|
| Specimens | Total chloride (% mass of binder) | W/C | OPC ($kg/m^3$) | Fine aggregate ($kg/m^3$) | Coarse aggregate ($kg/m^3$) |
| 1 and 2 | 5% at the ends | 0.45 | 371 | 756 | 1031 |
| 3 and 4 | 3% at the ends | 0.45 | 371 | 756 | 1031 |

Several specimens were prepared for this experiment. One set of specimens simulated the actual patch repair work in the construction field according to the prior art, while the other set of specimens incorporate the buffer discussed above. The opposing end portions of each of these specimens were cast to contain chloride, two having 5% and another two having 3% chloride content. The middle portion of these specimens was east after 24 hours with no chloride content to simulate the repaired portion in the actual construction repairs to stop or minimize the chloride movement from contaminated to non-contaminated portions of these specimens. The purpose was to create an artificial macro-cell resembling the one developed originally in case of repair works in the actual field of concrete structures.

One of the 3% and 5% chloride contaminated specimens was repaired in the typical manner discussed above according to the prior art, as shown diagrammatically in FIG. 2. This set served as a control for comparison purposes. The other 3% and 5% chloride contaminated specimens were repaired incorporating the buffer 20 according to the present method, as shown diagrammatically in FIG. 1. In the latter case, the buffer 20 was used to avoid the formation of a macro-cell due to the separation of anode and cathode, which characteristically occurs between the old and the new rebar sections. To investigate the results of the specimens, corrosion potential readings of the specimen were taken for one year using a copper-copper sulfate reference electrode (CSE) in accordance with standard specifications ASTM C 876-91.

After one year of corrosion potential readings the results from the two sets of specimens were compared.

Figure 3:
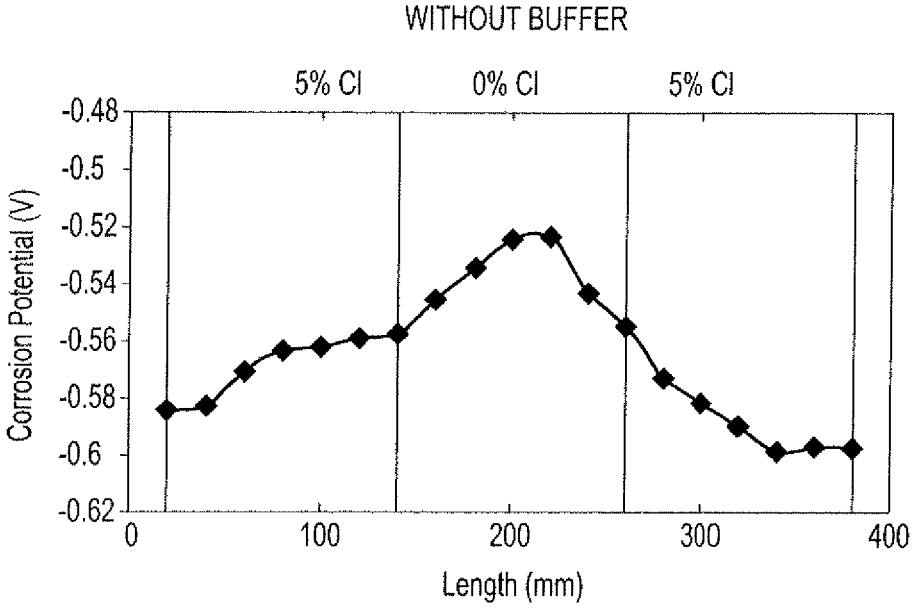
FIG. 3 is a chart of corrosion potential vs. length, showing the averaged one-year corrosion potential values of a simulated reinforced concrete specimen repaired without a buffer, the concrete specimen having about 5% Cl contaminated content at the ends.
Figure 4:
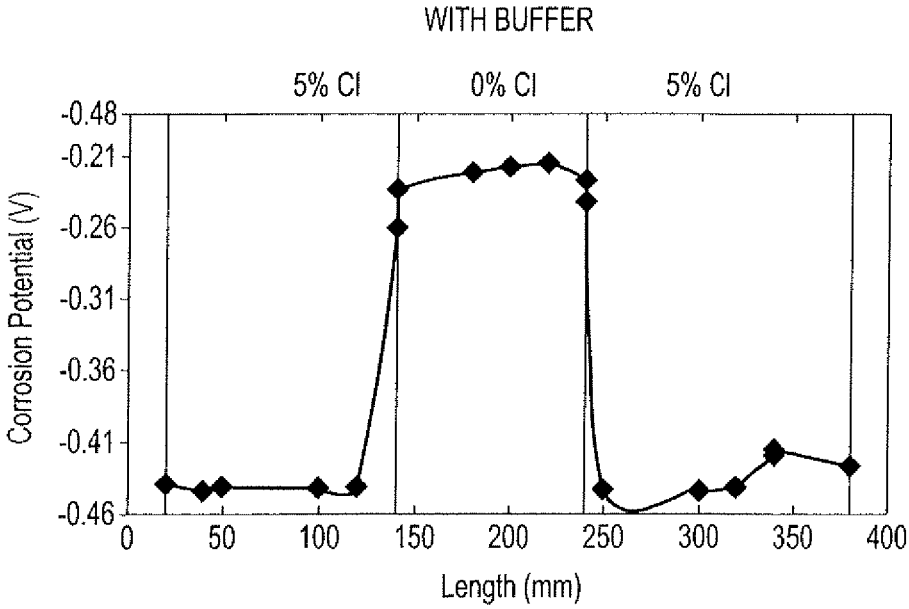
FIG. 4 is a chart of corrosion potential vs. length, showing the corrosion potential values of a simulated reinforced concrete specimen repaired with a buffer, the concrete specimen having about 5% Cl contaminated content at the ends.
Figure 5:
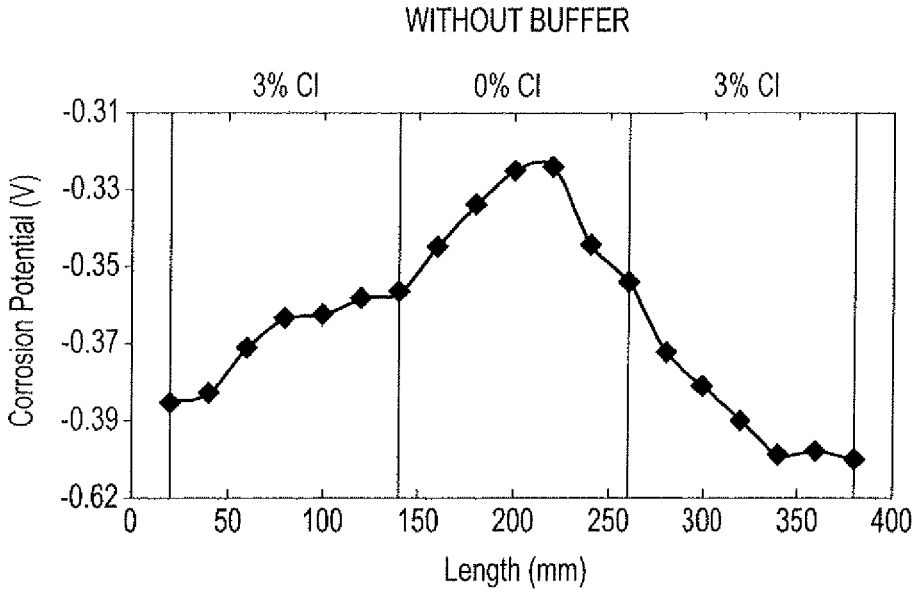
FIG. 5 is a chart of corrosion potential vs. length, showing the corrosion potential values of a simulated reinforced concrete specimen repaired without a buffer, the concrete specimen having about 3% Cl contaminated content at the ends.
Figure 6:
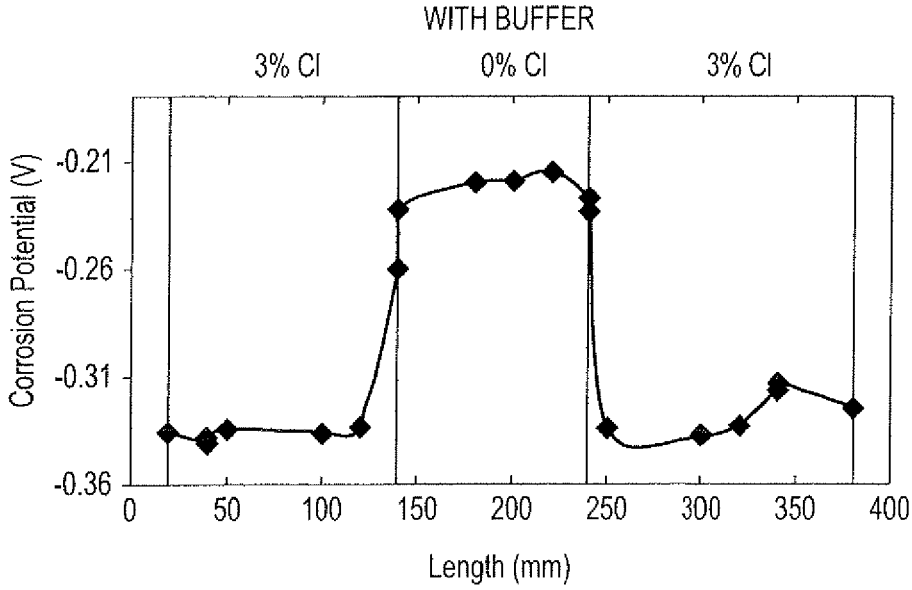
FIG. 6 is a chart of corrosion potential vs. length, showing the corrosion potential values of a simulated reinforced concrete specimen repaired with a buffer, the concrete specimen having about 3% Cl contaminated content at the ends.

It had been found that the middle, non-contaminated portion of the specimens repaired with the buffer 20 had low maximum corrosion potential of about −0.23 Volts, as compared to the high −0.55 Volts in the middle, non-contaminated portion of the specimens repaired without the buffer 20. This low corrosion potential value of −0.23 Volts at middle showed that there was no corrosion at the middle portion of these specimens having the buffer 20. Compare the charts shown in FIGS. 3 and 4 for the 5% Cl content, and the charts shown in FIGS. 5 and 6 for the 3% Cl content. Moreover, this low corrosion potential value also suggested that there was no separation of anode and cathode, which would lead to the development of the macro-cell in the middle portion, simulating the actual patch repair in the field.

There was no appearance of crack formation after one year in the specimens having the buffer 20, while the specimens without the buffer showed cracks at the opposing ends propagating towards the center. This suggested a much higher corrosion rate compared to a normally corroded reinforced concrete with similar chloride concentrations. The cause can be attributed to the formation of the macro-cell.

It is to be understood that the present invention is not limited to the embodiments described above, but encompasses any and all embodiments within the scope of the following claims.

We claim:

1. An induced macro-cell corrosion prevention method in construction repairs, comprising the steps of:

removing a section of corroded concrete and steel reinforcement from an affected area in the middle of a steel-reinforced span of a concrete structure, leaving cut ends of a remaining section of the steel reinforcement separated by the removed section;

installing a non-contaminated steel reinforcement between the cut ends of the remaining steel reinforcement, the non-contaminated steel reinforcement having opposing ends;

attaching a non-conductive and electrically insulating buffer to each end of the non-contaminated steel reinforcement, the buffer being disposed directly between the non-contaminated steel reinforcement and the corresponding cut end of the remaining steel reinforcement, the buffer preventing metal to metal contact between the respective steel reinforcements; and filling the removed area with non-contaminated concrete;

whereby, the buffer prevents formation of a macro-cell in order to prevent further corrosion.

2. The induced macro-cell corrosion prevention method according to claim 1, wherein said buffer comprises a plastic insulator.

3. The induced macro-cell corrosion prevention method according to claim 1, wherein said buffer comprises a polymeric insulator.

* * * * *